United States Patent [19]

Koch et al.

[11] Patent Number: 4,630,516

[45] Date of Patent: Dec. 23, 1986

[54] ECCENTRIC PRESS

[75] Inventors: Elmar Koch, Bad Homburg; Hermann Gleich, Friedrichsdorf, both of Fed. Rep. of Germany

[73] Assignee: Mabu-Pressen Maschinenfabrik Karl Burkard KG, Oberursel, Fed. Rep. of Germany

[21] Appl. No.: 676,829

[22] Filed: Nov. 30, 1984

[51] Int. Cl.[4] ..... B26D 5/18; B26D 7/26

[52] U.S. Cl. ..... 83/530; 74/603; 83/615; 83/626; 83/630; 83/632; 100/257

[58] Field of Search ..... 83/530, 626, 630, 632, 83/615; 74/603; 100/257, 286

[56] References Cited

U.S. PATENT DOCUMENTS

| | | | |
|---|---|---|---|
| 1,341,312 | 5/1920 | Glines | 83/530 X |
| 3,147,695 | 9/1964 | Hyman | 83/530 X |
| 4,160,409 | 7/1979 | Portmann | 83/632 X |
| 4,318,325 | 3/1982 | Bareis et al. | 83/626 X |

FOREIGN PATENT DOCUMENTS

| | | | |
|---|---|---|---|
| 589685 | 12/1933 | Fed. Rep. of Germany | 83/626 |
| 2900901 | 7/1980 | Fed. Rep. of Germany . | |
| 2934286 | 3/1981 | Fed. Rep. of Germany . | |
| 1450178 | 7/1966 | France . | |
| 226734 | 10/1910 | German Democratic Rep. . | |
| 973262 | 12/1959 | German Democratic Rep. . | |

*Primary Examiner*—Frank T. Yost

*Attorney, Agent, or Firm*—Staas & Halsey

[57] ABSTRACT

An eccentric press which can be constructed a single connecting rod machine or a twin connecting rod machine is described. The press includes a stroke adjustment means having a support lever which is articulately connected at the joint between the two portions of a lever arrangement. The articulation joint is guided on an adjustable path of movement and the foot point of the support lever is guided variably in its position on a circular arc, the center point of the circular arc coinciding with the position of the articulation point which corresponds to the bottom dead center of the ram. As a result, a change in the ram stroke does not change the bottom dead center of the ram, only one ram stroke being executed per connecting rod revolution.

8 Claims, 4 Drawing Figures

ECCENTRIC PRESS

BACKGROUND OF THE INVENTION

The invention relates to an eccentric press.

An eccentric press preamble is known for example from FR-PS No. 1,450,178. This eccentric press comprises a drive mechanism which is provided with a means for continuous adjustment of the working stroke. For this purpose the tool is connected via a lever arrangement to a connecting rod disposed on an eccentric of the drive mechanism. In the articulation joint between lever and connecting rod a support lever engages which guides the joint of the lever arrangement on an adjustable movement path and the foot of which is variable in its position on a circular arc.

To enable the bottom dead center of the ram stroke to be kept constant in the eccentric press of FR-PS No. 1,450,178 the foot of the support lever is guided on a circular arc about the bottom dead center with a radius whose magnitude results from the addition of the lengths of the support lever and of the connecting lever articulated to the ram. A disadvantage here is however that only in the position of the support lever illustrated in FIG. 3 of FR-PS No. 1,450,178 is a ram stroke with the resulting stroke height executed per connecting rod revolution whereas in the positions of the support lever according to FIGS. 4 and 5 in each case two ram strokes per connecting rod revolution are executed, and in the position according to FIG. 4 the stroke heights are equal whereas in the position according to FIG. 5 they are unequal. The reason for this is that as already mentioned the foot of the support lever must be adjusted on the circular arc about the bottom dead center if the latter is to remain unchanged. This in turn means that the position shown in FIG. 3 in which the support lever and the connecting lever articulated to the ram are arranged in elongated position is an extreme position because only in this position of the support lever is a ram stroke with a predetermined stroke height executed per connecting rod revolution. Further, the position shown in FIG. 3 is an extreme position because on an adjustment of the foot of the support lever on the circular arc further to the left in the illustration chosen either a change in the bottom dead center would have to be accepted or if the bottom dead center is maintained a change of length of one of the levers would be necessary. Since however this would certainly not be done because of the high expenditure when operating the press the adjustment path for the support lever and thus the possibility of setting the stroke height is restricted to an adjustment range which in the illustration chosen extends to the right of the instantaneous foot of the support lever in FIG. 3 along the circular arc.

Summarizing, this means that the eccentric press of FR-PS No. 1,450,178 has the disadvantage that a ram stroke with a predetermined height can be executed only in one position of the support lever per connecting rod revolution but there is no position of the support lever which provides a change of the stroke height with only one stroke per connecting rod revolution. On the other hand, it is desirable in eccentric presses to have only one stroke per connecting rod revolution with predetermined adjustable stroke height because only then is it possible per connecting rod revolution to carry out a production operation with the stroke height necessary for a particular production step.

SUMMARY OF THE INVENTION

It is therefore the purpose of the invention to provide an eccentric press which permits adjustment of the stroke height keeping constant the bottom dead center of the ram stroke and maintaining one stroke per connecting rod revolution.

The fact that the center point of the circular arc along which the foot of the support lever can be adjusted coincides with the position of the articulation point between the connecting rod and the lever arrangement which corresponds to the bottom dead center of the ram first achieves that a stroke adjustment does not change the bottom dead center of the ram. This has the advantage that a change in the ram stroke does not require any additional adjustment work, for example in the form of readjustment of the bottom dead center of the ram. The eccentric press according to the invention thus permits a very rapid and nevertheless reliable adjustment of the ram stroke. It is further achieved that a change of the ram or slide stroke in the eccentric press according to the invention is possible over a wide range in which the ram executes only one stroke per connecting rod revolution.

Admittedly, DE-P No. 226,734 of 1908 discloses a drive mechanism for machines with variable stroke which comprises a lever for adjusting the stroke whose foot point is guided on a circular arc whose center point coincides with the position of the articulation point which connects the transmission levers and which represents the bottom dead center of the stroke movement. However, apart from the fact that the drive mechanism of DE-PE No. 226,734 is provided in particular for metal cold saws in which the conditions are fundamentally different to those in eccentric presses, above all there is the difference compared with the eccentric press according to the invention that in the drive mechanism of DE-PS No. 226,734 the lever arrangement connecting the connecting rod to the metal cold saw has an extended attitude at least in the position of the bottom dead center. Thus, in contrast to the eccentric press according to the invention in which the connecting rod and lever arrangement are always at an angle to each other the stroke of the drive mechanism of DE-PS No. 226,734 results from the bend of said levers, and the extent of the bend can be dependent on the variable position of the support lever so that the extent of the bend between the connecting levers is not equal to the stroke of the metal cold saw. On the contrary, the stroke results indirectly from the position of the support lever. In contrast, in the eccentric press according to the invention by varying the position of the support lever the position of the two extreme points of the articulation joint on the circular arc are directly adjusted and this directly results in the change of the stroke because the vertical spacing between the extreme points of the articulation is equal to the ram stroke.

If the eccentric shaft in accordance with the present invention has two eccentric sections, one of which is engaged round by a connecting rod whilst the other comprises a counter weight for compensating the rotationally moved masses, the advantage is achieved that the eccentric press according to the invention is always balanced as regards the rotationally moved masses, irrespective of the setting of the ram stroke. This is achieved in that in the eccentric press according to the invention a separation is made between the stroke determination and the eccentricity of the connecting rod.

This also has the advantage that there is no combination of the balancing between the rotationally moved masses and the reciprocated masses and consequently the rotational and the translatory mass balancing can be made separately in each case. This has particular constructional and design advantages because it is not necessary to calculate any complicated combined movements of rotational and translatory mass balancing.

The advantages of the eccentric press according to the invention are particularly apparent when said press is constructed as a twin connecting rod machine. Such an eccentric press according to the invention comprises two eccentric portions of variable eccentricity which are disposed in opposite senses on a driven eccentric shaft and each of which is engaged by a connecting rod. The connecting rods are connected in each case to the press ram with a lever arrangement comprising two angled and articulately interconnected portions, the support levers of the stroke adjustment means engaging in the articulation point between the portions of the respective lever arrangement. The portion of the lever arrangement which is connected directly to the connecting rod and which connects the latter to the portion of the lever arrangement whose other end is articulately connected to the ram is guided in a straight-line motion and this avoids wobbling movements of the ram. The rectilinearly guided portions of the lever arrangements are disposed at an angle to each other and this has the advantage that in the construction of the eccentric press according to the invention there is great flexibility as regards the design. This may for example advantageously manifest itself in that by a particularly high arrangement of the eccentric shaft and a resulting roof-like arrangement of the rectilinearly guided portions of the lever arrangements the eccentric press according to the invention can be made high and narrow as is frequently desirable because machine halls are usually adequately high but to save space the width of the machines should be kept as small as possible. Such a design can be obtained with the eccentric press according to the invention easily by said locating of the eccentric shaft at the top giving a narrow machine. In an eccentric press made in this manner the rotational mass balancing is similar to that in balancing of V engines.

With the present invention the particular advantage is achieved that with horizontally disposed rectilinearly guided lever portions no additional rotation mass balancing is necessary because due to the arrangement of the connecting rods such rotational inertia forces automatically cancel each other out.

A further advantage of the eccentric press according to the invention resides in that the drive forces generated by the connecting rod movement can be transmitted free from bending moments to the ram by means of the lever arrangement provided for the force transmission. As a result no sagging or deflections occur in the ram drive and this avoids tilting of the ram on one-sided loading in particular in the case of two, i.e. twin, connecting rod machines.

In addition, in particular the eccentric press according to the invention constructed as a twin connecting rod machine has all the advantages peculiar to eccentric presses with a non-adjustable double eccentric. These advantages include in particular a high functional reliability because due to the non-adjustable eccentric no fitting rust can occur which impairs the mode of operation of the adjustment mechanism. Furthermore, when using a double eccentric with fixed stroke no adjustable rotational mass balancing is needed because the stroke adjustment is not effected by means of changing the eccentricity.

A further advantage of the eccentric press according to the invention resides in that the constructional expenditure for the ram guiding can be substantially reduced because the nature of the force introduction itself can prevent the occurrence of tilting moments.

Further details, features and advantages of the invention will be apparent from the following description of three embodiments with the aid of the drawings, wherein:

DETAILED DESCRIPTION OF THE PREFERRED EMBODIMENT

Figure 1:
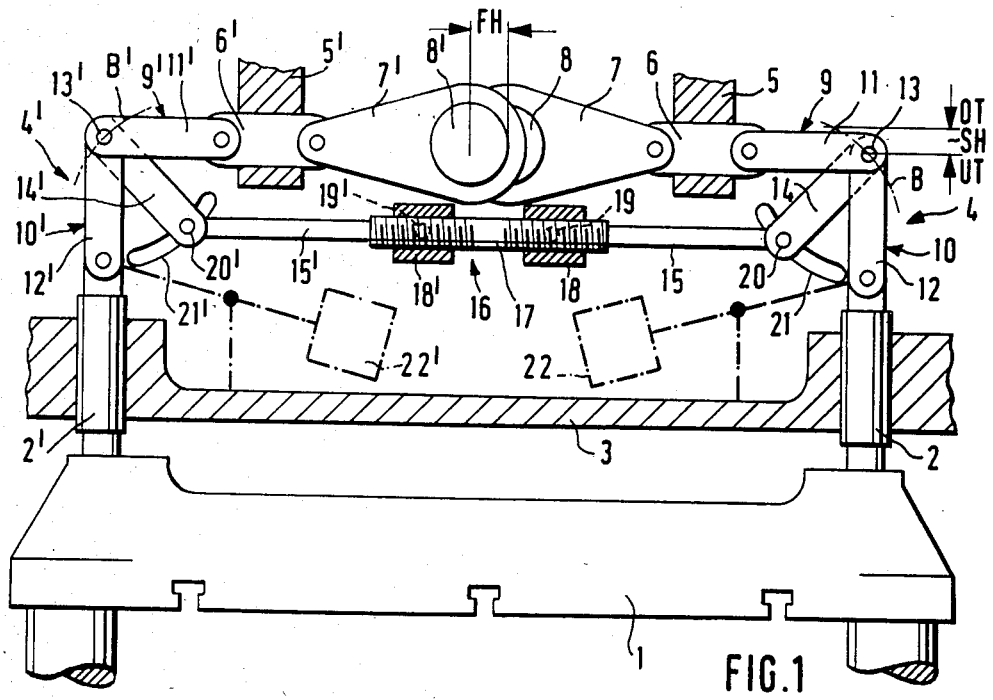
FIG. 1 is a schematically simplified sectional view of the ram drive of an eccentric press constructed according to the invention as a twin connecting rod machine.
Figure 2:
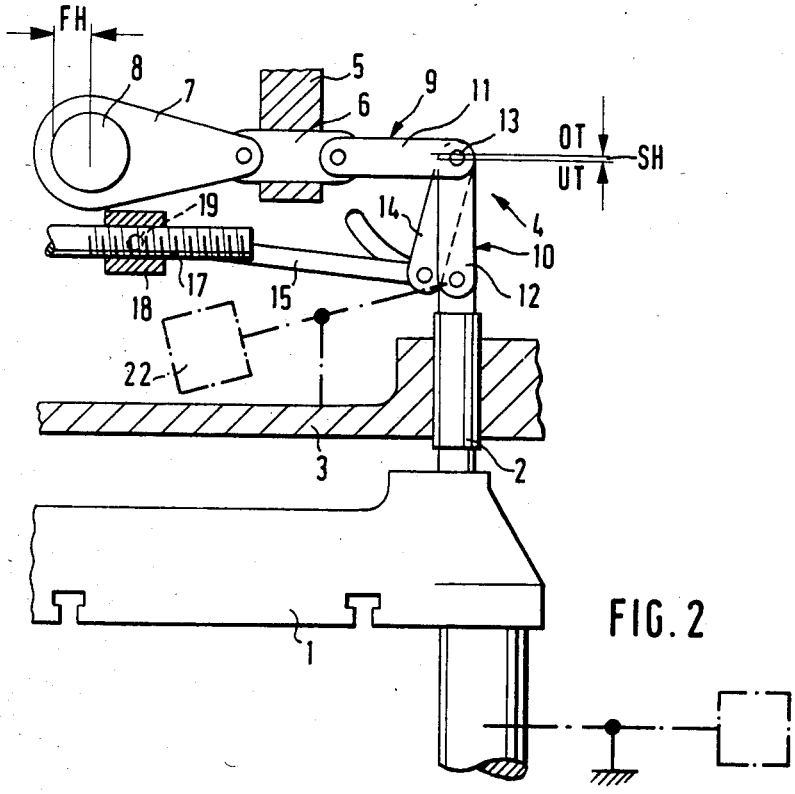
FIG. 2 is an illustration corresponding to FIG. 1 of part of the ram drive of the eccentric press according to FIG. 1 with a ram stroke modified compared with that of FIG. 1.
Figure 3:
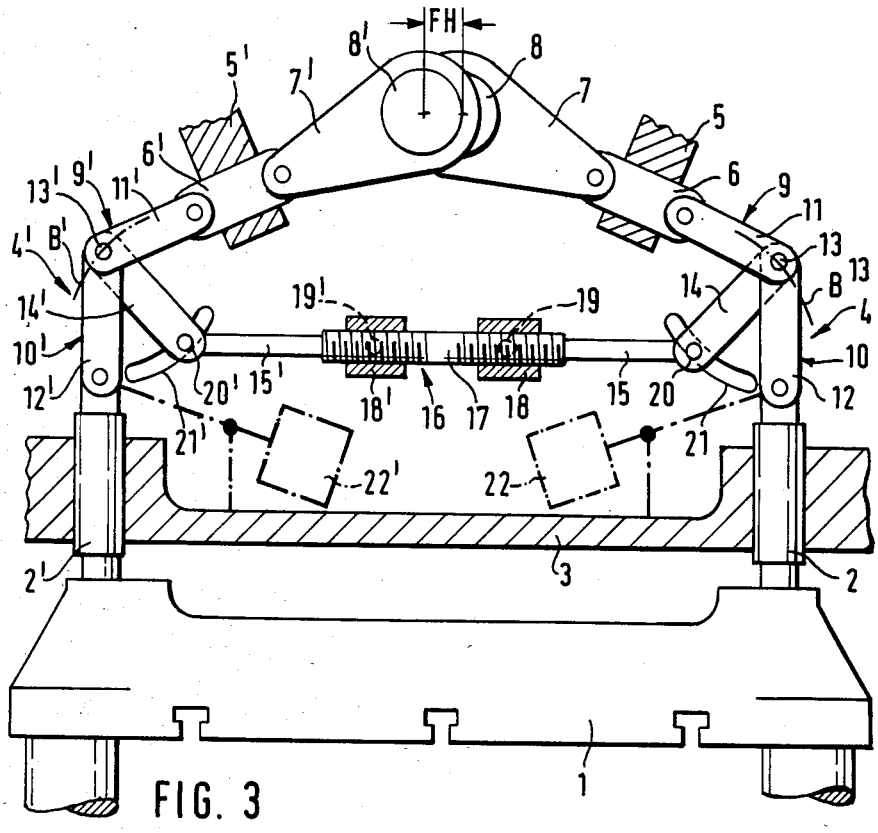
FIG. 3 is an illustration corresponding to FIGS. 1 and 2 of a second embodiment of an eccentric press according to the invention constructed as a twin connecting rod machine.

The embodiments of an eccentric press according to the invention illustrated by way of example in FIGS. 1 to 3 are twin connecting rod machines whose construction is strictly symmetrical. For this reason parts corresponding to each other are provided with identical reference numerals, the press parts lying on the plane of symmetry on the left side in the illustration chosen being provided with an apostrophe. The embodiment according to FIG. 3 differs from that of FIGS. 1 and 2 only in a different arrangement of the eccentric shaft and for this reason for simplicity in this embodiment as well the same reference numerals as in the embodiment of FIGS. 1 and 2 are used because the function of the corresponding parts is the same as in the embodiment according to FIGS. 1 and 2.

FIG. 1 shows in schematically simplified form part of an eccentric press according to the invention which comprises a ram 1 which is mounted for translational movement by means of plunger guides 2, 2' in a bearing member 3 fixed with respect to the housing. Articulately connected to the plunger guides 2, 2' are two lever arrangements 4, 4' which in turn are articulately connected to two connecting levers 6, 6' mounted for longitudinal movement in bearing members 5, 5' fixed with respect to the housing. The connecting levers 6, 6' are articulately connected to a connecting rod 7, 7' respectively.

The bearing members 5, 5' which are fixed with respect to the housing and which support connecting levers 6, 6' constructed for example in the manner of plungers form rectilinear guides for the connecting levers 6, 6' so that wobbling movements of the ram 1 which would occur if the connecting levers 6, 6' were not rectilinearly guided are avoided. The horizontal arrangement of the bearing members 5, 5' illustrated in FIG. 1 and thus the horizontal arrangement of the connecting levers 6, 6' and connecting rods 7, 7' has the particular advantage that the rotational mass compensation of the connecting rods 7, 7' is obtained automatically due to their horizontal arrangement in the manner of an opposed cylinder engine so that no additional balancing steps are necessary.

However, as clearly shown by FIG. 3 a non-horizontal arrangement of the connecting levers 6, 6' is also possible. This arrangement can be chosen when the eccentric press is to be made particularly narrow, an increased height of the machine not involving any problem. In such a case the eccentric shaft is arranged correspondingly higher so that the connecting levers 6, 6' are disposed in the example at an acute angle to each other but are again guided rectilinearly in the bearing members 5, 5' fixed with respect to the housing to enable any undesired wobbling movements of the ram 1 to be avoided. To obtain rotational mass balance of the connecting rods 7, 7' in an eccentric press constructed in this manner balancing weights (not illustrated) are provided so that the embodiment of the eccentric press according to the invention illustrated in FIG. 3 is provided with rotational mass balancing in the manner of that in V engines.

The connecting rods 7, 7' in the embodiments of FIGS. 1 to 3 each engage round an eccentric portion 8, 8' of an eccentric shaft not visible in FIGS. 1 to 3. The eccentric portions 8, 8' are disposed with unchangeable eccentricity on the eccentric shaft which results in a fixed stroke designated in the Figures by FH.

The lever arrangements 4, 4' have two articulately interconnected portions 9, 9' and 10, 10' which connect the connecting rods 7, 7' to the ram 1 for converting the connecting rod movement to the ram stroke. In the example the portions 9, 10 and 9', 10' each comprise a lever 11 and 12 and 11' and 12' respectively. The levers 11 and 12 and 11' and 12' are arranged at an angle to each other and connected in each case by means of an articulation joint 13, 13' to each other. A support lever 14, 14' engages in the articulation joints 13, 13' respectively. The support levers 14, 14' are each connected articulately to adjustment rods 15, 15'. The adjustment rods 15, 15' form a part of a central stroke adjustment means 16 which apart from the rods 15, 15' comprises in the example a threaded rod 17 on which are arranged two adjustment members 18, 18' provided with internal thread. The adjustment members 18, 18' are connected to the adjustment rods 15 and 15' respectively in each case by means of an articulation joint 19, 19'. The joints 20, 20' connecting the support levers 14, 14' to the adjustment rods 15, 15' are each guided in an arcuate guide 21 and 21' respectively.

For mass balancing of the translationally moved press parts two counterweights 22 and 22' are provided whose construction and arrangement is shown only in principle. An arrangement of the counter weights in the upper part of the machine as indicated in FIG. 1 has the advantage that the overall center of gravity of the machine is located further up. Firstly, with such an arrangement the press drive forms a compact constructional unit and secondly the leverage resulting between the overall center of gravity and the tilting force and undesirable inequilibrium which can never be completely removed becomes smaller and as a result the tilting moment is minimized. If however the space conditions or other circumstances require the counterweights to be located in other areas of the machine this is possible for example according to FIG. 2 also in the region of the ram column because with this arrangement as well of the counterweights designated by 22 in this region a mass balancing of the translatory moved press parts is readily possible.

As apparent from FIGS. 1 to 3 the articulations 13 and 13' between the two portions 9 and 10 and 9' and 10' respectively of the lever arrangements 4 and 4' are forcibly guided on an adjustable movement path B and B' respectively. The constrained guiding consists of the articulation of the support levers 14 and 14' in the joint 13 and 13' and the adjustability by the variable position of the foot point of the support levers 14, 14' in the arcuate guides 20 and 21' respectively. Due to this guiding in conjunction with the reciprocating drive motion of the connecting rods 7 and 7' the joints 13 and 13' reciprocate on the arc B and B' respectively between the top dead center OT and the bottom dead center UT, the position of the top dead center OT and that of the bottom dead center UT on the arcs B and B' resulting from the position of the support levers 14 and 14' adjustable by means of the stroke adjustment means 16. The vertical spacing in the illustration chosen between the top dead center OT and the bottom dead center UT forms the set ram stroke SH. In the eccentric press according to the invention the center point of the arc on which the foot of the support lever 14 or 14' which is formed in the example by the joints 20 and 20' respectively and which is variably arrangeable for adjusting the ram stroke SH coincides with the position of the joint 13 and 13' which corresponds to the bottom dead center UT of the ram. This has the advantage that irrespective of the choice of the ram stroke SH the ram itself is moved always only up to its bottom dead center so that a readjustment of the starting position of the ram for avoiding the ram striking the tool table is not necessary. Furthermore, the eccentric press according to the invention also has the advantage that over a wide adjustment range for the ram stroke one stroke per connecting rod revolution is carried out.

Although an adjustment of the starting position of the ram is not necessary an adjusting means for the vertical position of the ram which is not illustrated in detail and is of known construction is nevertheless provided to meet particular requirements and circumstances including the possibility of fine adjustment of the ram position.

By means of the stroke adjustment means 16 an infinitely variable adjustment is obtained using the infinitely variable adjustability of the position of the adjustment members 18 and 18' on the threaded rod 17 and thus a change in the position of the adjustment rods 15 and 15' and the consequent change in the position of the support lever 14 and 14' respectively. The ram stroke SH according to FIG. 2 decreases on variation of the position of the support lever 14 towards the lever 12 whilst the ram stroke SH in accordance with FIG. 1 on adjustment of the support lever 14 in the opposite direction increases. The same applies of course also to the symmetrical left side of the eccentric press not shown in FIG. 2 and to the second embodiment of the eccentric press according to the invention illustrated in FIG. 3.

Since all the levers of the ram drive of the eccentric press according to the invention are made rectilinear and articulately connected to each other a force transmission free from bending moments is possible from the connecting rods 7, 7' to the ram 1. Thus, no deflections occur which on unilateral loading of the ram could bring the latter into inclined positions and this results inter alia in the advantage of long service lives and low constructional expenditure for the ram guiding.

For punching or cutting operations it is favorable for the ram to run as slowly as possible during the cutting. In the embodiment of the eccentric press illustrated in FIGS. 1 to 3 a further improvement of the speed behavior of the ram 1 is made possible in that the support levers 14, 14' are displaced upwardly with respect to the illustrated arrangement by 90° or 180° and can thus be supported above the plane of the portions 9, 9'. By this step the region of the arc B of low slope is moved into the end face of the ram movement during which the cutting operation takes place. Since the slope of the arc B is a measure of the ram speed this step results in exactly the desired effect of lower ram speed during the cutting operation without changing anything else in the structure or design of the eccentric press according to the invention.

Figure 4:
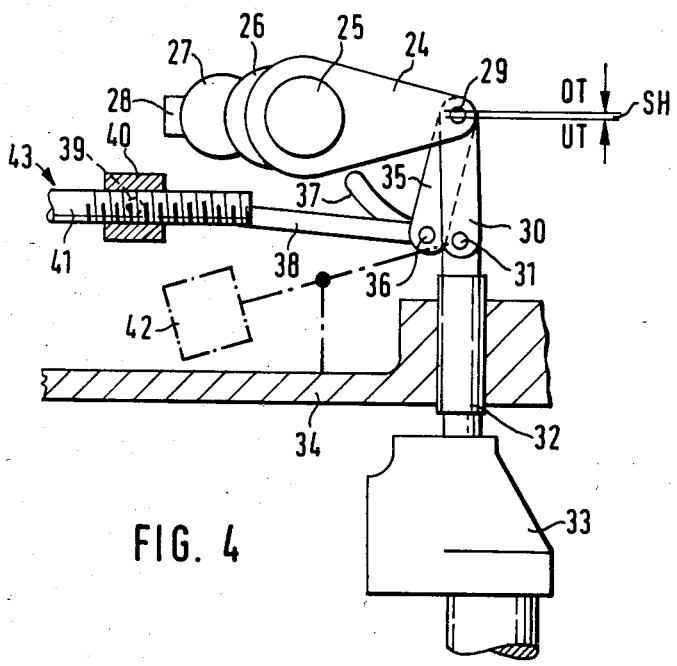
FIG. 4 is an illustration corresponding to FIGS. 1 to 3 in side elevation of an eccentric press according to the invention constructed as single connecting rod machine.

The third embodiment of the eccentric press according to the invention illustrated in FIG. 4 is constructed as single connecting rod machine. It comprises a connecting rod 24 disposed on an eccentric portion 25 of an eccentric shaft 26. In the example the eccentric shaft 26 comprises a further eccentric portion 27 disposed in the opposite sense to the eccentric portion 25 and provided with a counterweight 28 which is shown schematically in simplified manner and which permits rotational mass balancing of the connecting rod 24. The embodiment of the eccentric press according to the invention illustrated according to FIG. 4 thus also has an eccentric shaft with fixed stroke so that a stroke adjustment need not take place via changing the eccentricity.

At the foot of the connecting rod 24 by means of a pin 29 a lever 30 is articulately connected which in turn is articulately connected by means of a further pin 31 to a plunger guide 32 which connects the connecting rod 24 to a ram slide 33. The plunger 32 is mounted slidingly in a bearing member 34 fixed with respect to the housing.

Articulately connected in the joint point 29 between the connecting rod 24 and the lever 30 is one end of a support lever 35 whose foot point constructed as articulation joint 36 is disposed in a guide 37. The joint 36 is connected to an adjustment rod 38 which in turn is connected by means of a joint 39 to an adjustment member 40 which is disposed on a threaded rod 41.

To balance the translationally moved masses of the embodiment of the eccentric press according to the invention shown in FIG. 4 a counterweight 42 is provided which is disposed in the example in the upper region of the machine. Moreover, in the embodiment according to FIG. 4 as in the embodiments of FIGS. 1 to 3 the translational mass balancing can also take place in the lower region of the machine so that the translational mass balancing can be provided in the same manner as in the embodiments of FIGS. 1 to 3. Likewise, the stroke adjustment means 43 comprising the support lever 35, the arcuate guide 37, the adjustment rod 38 and the threaded rod 41 and the adjustment member 40 is constructed like the stroke adjustment means 16 of the embodiments of FIGS. 1 to 3 and also corresponds in its mode of operation to the stroke adjustment means 16. Thus, the embodiment of the eccentric press according to the invention as shown in FIG. 4 has the advantages already explained with reference to the examples of the previous embodiments. In addition, the embodiment according to FIG. 4 has the advantage of a particularly simple constructional form because in a single connecting rod machine it is not necessary to provide between the connecting rod and the lever 30 articulately connected to the ram 33 and the plunger a further rectilinearly guided lever arrangement. On the contrary, in the embodiment of the eccentric press according to FIG. 4 it is possible to go directly from the connecting rod 24 to the lever and this constructionally considerably reduces the expenditure.

Further, the embodiment of the eccentric press according to the invention as single connecting rod machine has the advantage that the press drive with flywheel and connecting rod and all the other associated parts can be moved to the rear region of the eccentric press so that the embodiment of FIG. 4 has particular advantages as regards the great variety of possible constructional variations.

In addition, the single piston rod machine retains the advantage of a permanent rotational balancing because in the construction according to FIG. 4 the eccentric shaft 26 comprises two eccentric portions 25 and 27 which permits permanent rotational balancing of the machine by attaching the counterweight 28 on the oppositely directed eccentric 27.

We claim:

1. An eccentric press, comprising:

at least one eccentric portion which is disposed on a driven eccentric shaft, has invariable eccentricity and is engaged by a connecting rod;

at least one lever arrangement which connects the connecting rod to a press ram for converting movement of the connecting rod to a press ram stroke;

a counterweight for mass balancing the eccentric press during movement; and a stroke adjustment means including a support lever which is articulately connected to an articulation point between the lever arrangement and an adjustment rod and which guides a joint at one end thereof on an adjustable movement path and whose other end thereof is guided variably in a circular arc, wherein a center point of the circular arc coincides with the articulation point, which corresponds to a bottom dead center of the press ram.

2. The eccentric press according to claim 1, wherein the driven eccentric shaft comprises:

two eccentric portions, one of which is engaged by a connecting rod and the other of which includes a counterweight disposed for rotational mass balancing.

3. The eccentric press according to claim 1, wherein two connecting rods and two lever arrangements are provided, each lever arrangment including two portions angled with respect to each other, in the articulation point of which the support levers of the stroke adjustment means engage, and wherein the two portions of each lever arrangement engaging the connecting rods are each guided in a rectilinear guide.

4. The eccentric press according to claim 3, wherein the rectilinear guide is disposed horizontally.

5. The eccentric press according to claim 1, wherein the adjustment rod is adjustable for changing the press ram stroke.

6. The eccentric press according to claim 2, wherein the adjustment rod is adjustable for changing the press ram stroke.

7. The eccentric press according to claim 3, wherein the adjustment rod is adjustable for changing the press ram stroke.

8. The eccentric press according to claim 4, wherein the adjustment rod is adjustable for changing the press ram stroke.

* * * * *